US007029272B2

(12) United States Patent
Jordan et al.

(10) Patent No.: US 7,029,272 B2
(45) Date of Patent: Apr. 18, 2006

(54) PREMIX BURNER AND METHOD FOR OPERATION THEREOF

(75) Inventors: Karsten Jordan, Essen (DE); Holger Streb, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/764,290

(22) Filed: Jan. 23, 2004

(65) Prior Publication Data

US 2005/0079464 A1 Apr. 14, 2005

(30) Foreign Application Priority Data

Aug. 9, 2001 (EP) ..... 01119249
Jul. 26, 2002 (EP) ..... PCT/EP02/08354

(51) Int. Cl.
*F23Q 9/00* (2006.01)

(52) U.S. Cl. ..... 431/278

(58) Field of Classification Search ..... 431/278, 431/328, 39, 346, 350; 60/748; 122/14
See application file for complete search history.

(56) References Cited

U.S. PATENT DOCUMENTS

| | | | | |
|---|---|---|---|---|
| 3,954,384 | A | 5/1976 | Tyler | |
| 5,022,849 | A | 6/1991 | Yoshii et al. | |
| 5,080,577 | A * | 1/1992 | Bell et al. | 431/7 |
| 5,317,992 | A * | 6/1994 | Joyce | 122/18.31 |
| 5,879,154 | A * | 3/1999 | Suchovsky | 431/326 |

FOREIGN PATENT DOCUMENTS

| | | | |
|---|---|---|---|
| DE | 196 37 727 | A1 | 3/1998 |
| EP | 0 193 838 | | 9/1986 |
| EP | 0 576 697 | B1 | 1/1994 |
| EP | 0 710 797 | A2 | 5/1996 |
| EP | 1 062 461 | B1 | 12/2000 |
| GB | 1 377 648 | | 12/1974 |
| WO | WO 00/46548 | * | 8/2000 |

* cited by examiner

*Primary Examiner*—S. Gravini

(57) ABSTRACT

The invention relates to a pre-mix burner with a main burner and a pilot burner, for stabilization of the main burner. The pilot burner comprises a fine-pored burner material, which permits a combustion with low nitrogen oxide content, which is not susceptible to combustion variations.

19 Claims, 2 Drawing Sheets

PREMIX BURNER AND METHOD FOR OPERATION THEREOF

CROSS REFERENCE TO RELATED APPLICATIONS

This application is the U.S. National Stage of International Application No. PCT/EP02/08354, filed Jul. 26, 2002 and claims the benefit thereof. The International Application claims the benefits of European application No. 01119249.9 filed Aug. 9, 2001, both of the applications are incorporated by reference herein in their entirety.

FIELD OF THE INVENTION

The invention relates to a pre-mix burner, especially for a gas turbine, with a main burner and a pilot burner stabilizing the main burner. It further relates to a method of operating a pre-mix burner.

BACKGROUND OF INVENTION

A burner for a gas turbine is known from U.S. Pat. No. 6,202,401. This burner is designed as a hybrid burner and operates as either diffusion or a pre-mix burner. Whereas with diffusion combustion, fuel and combustion air are mixed in the flame, with pre-mix combustion the combustion air is initially intensively mixed with the fuel and this mixture is then fed in for combustion. This is especially advantageous as regards nitrogen oxide emissions, since there is an even temperature in the precombustion flame because of the homogeneous mixture. Generation of nitrogen oxide increases exponentially with the flame temperature.

With pre-mix combustion a leaner combustion can take place so that there is a higher ratio of combustion air to fuel present than with diffusion combustion. This in its turn reduces generation of nitrogen oxide. However a leaner combustion has a greater tendency to produce combustion instabilities and has a smaller range of regulation than diffusion combustion. Therefore pre-mix combustion is frequently stabilized by a diffusion flame. However, the fact that with this system nitrogen oxide is generated in the diffusion means that the benefit of nitrogen oxide reduction from leaner pre-mix combustion is to some extent exhausted again.

With a burner system known from U.S. Pat. No. 3,954,384 a fuel feed system supplies a main burner and a pilot burner that lights the main burner. The flame of the pilot burner is monitored by a vessel containing porous material that is used for absorption of a gas to be analyzed.

EP 1062461 A1 shows a combustion chamber with a cladding of heat shield elements. A heat shield element is designed as a burner heat shield element to which combustion air and fuel are fed. In a possible embodiment the heat shield element is designed as a porous burner. The combustion reaction here takes place at least partly in a porous material. This stabilizes the combustion and reduces the tendency for formation of combustion variations.

In EP 0576697 B1 a gas turbine is described in which catalytic burners are also used in addition to classical burner types. The classical burner types are pre-mix burners with which main combustion is undertaken. Combination with catalytic burners allows easier regulation for changing load states of the gas turbine.

SUMMARY OF INVENTION

The underlying object of the invention is to specify a pre-mix burner in which an especially low nitrogen oxide combustion is possible with a simultaneous lower tendency to combustion instabilities. Furthermore a corresponding method for operating a pre-mix burner and a gas turbine with low nitrogen oxide generation and less of a tendency to combustion instabilities is to be specified.

As regards the pre-mix burner, said object is achieved by the features of claim 1. This involves, for mixing the combustion air with fuel to a combustion mixture and for subsequent combustion of the combustion gas mixture, a main burner for the major part of the combustion air and a pilot burner to stabilize a leaner combustion in the main burner, in which case the pilot burner is designed as a pore burner with a burner material which features a fine-pore structure.

The idea behind the invention here is to design the pilot burner of a pre-mix burner as a pore burner. This means that the conventional diffusion burner is replaced by a pre-mix burner since the fuel and the combustion air are premixed before they enter the burner material. Initially it does not seem to make any sense to design the pilot burner as a pre-mix burner since it is precisely the unstable pre-mix combustion of the main burner that is to be stabilized by the pilot burner. In actual fact however trials have shown that the heating up of the burner material makes possible adequate stabilization by the pore burner designed as a pilot burner. At the same time a reduction in nitrogen oxide emissions is produced because of the smoothing out of the mixture that takes place in the porous combustion material.

The invention has found that the porous burner can be successfully used when the mass throughput of the fuel/air mixture is set correctly. The pressure ratios are set for this such that combustion reaction is not driven out of the porous body by too high a mass throughput. On the other hand the mass throughput may also not be so low for there to be a danger of a flame blowback.

The nitrogen oxide emissions are reduced by a strong heating up and thereby heat dissipation of the burner material, since this causes the flame temperature to drop. Furthermore the reaction densities in the overall burner flame are reduced while the output remains the same since a part of the reaction takes place in the porous burner material. Furthermore the combustion is stabilized by the especially low susceptibility of the porous burner to air or gas variations, in which case there is also at a particularly low susceptibility to combustion variations.

Advantageously the fine-pore structure is formed by foaming of a basic material. Foaming and subsequent hardening of the basic material is a simple way of producing a fine-pore structure.

Preferably the burner material is ceramic. A particular feature of a ceramic burner material is its high temperature stability. In this case the burner material preferably features zirconium oxide or silicon carbide. Alternatively the burner material is a Nickel or Cobalt-based super alloy or a highly heat-resistant steel. Such metallic materials can also be made of fine-pore metal foam and feature high temperature stability and good reworkability. It is also possible to design the burner as a metal mesh.

In an advantageous embodiment the main burner surrounds the pilot burner with a ring channel for the combustion air.

In a useful further development the pre-mix burner is used in a gas turbine, especially a stationary gas turbine. In a stationery gas turbine in particular such as is used to generate electrical energy it is a matter of low nitrogen oxide emission to reduce environmental damage and adhere to emission regulations. In addition variations in combustion in such gas turbines are associated with mechanical damage as result of high power releases.

The gas turbine preferably features a ring combustion chamber. With the ring combustion chamber coupling of all burners can result in combustion variations of especially high amplitude. Because of the complex geometry these variations are practically impossible to calculate in advance.

As regards the method, said object is achieved by the features of claim 10. Here a main burner mixes combustion air with fuel into a combustion gas mixture, with the combustion being stabilized in the main burner by a pilot burner and with combustion taking place in the burner in a fine-pore burner material.

BRIEF DESCRIPTION OF THE DRAWINGS

An exemplary embodiment of the invention is explained in more detail below on the basis of a diagram. The diagram shows.

Parts that correspond to each other are shown in all figures with the same reference numbers.

DETAILED DESCRIPTION OF INVENTION

Figure 1:
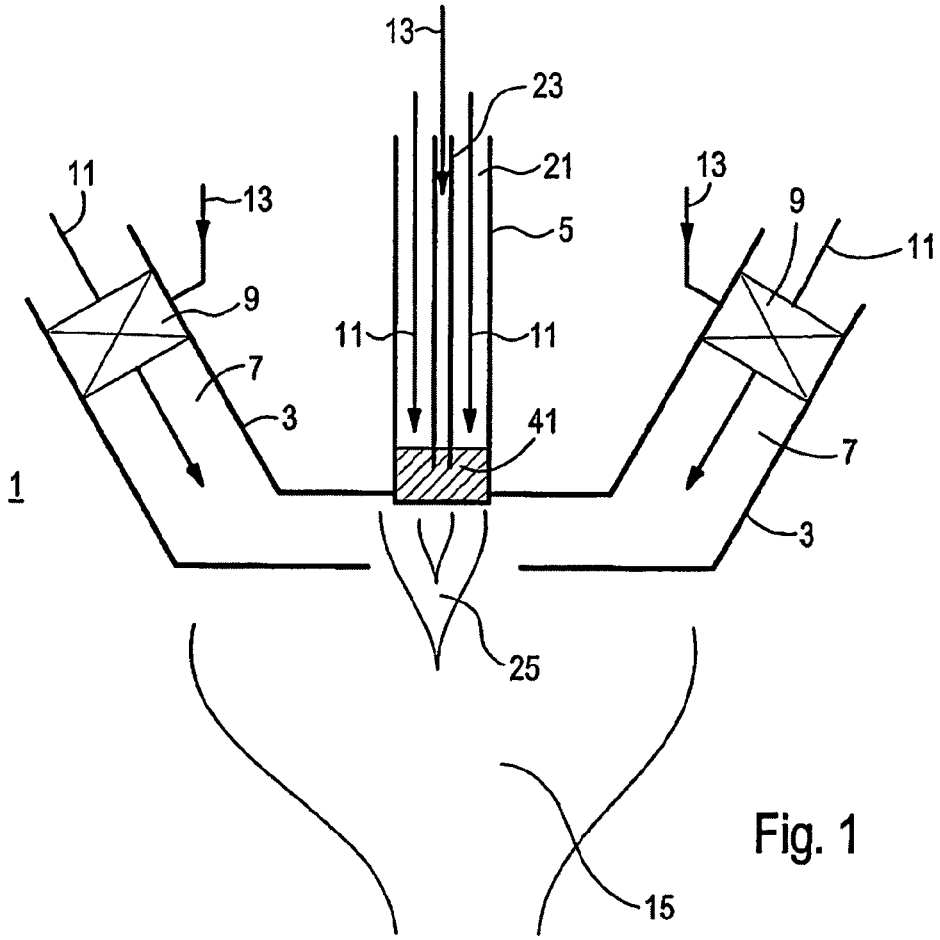
FIG. 1 a schematic of a pre-mix burner.

FIG. 1 shows a pre-mix burner 1 with a main burner 3 and with a pilot burner 5. The main burner 3 features a ring channel 7 that concentrically surrounds the pilot burner 5. Butterfly valves 9 are located in ring channel 7. Combustion air 11 is directed through the ring channel 7. Fuel 13 which is released from the fuel butterfly valves is mixed with combustion air 11 via hollow butterfly valves not shown in greater detail. The fuel 13 mixes intensively with the combustion air 11 before being burnt in a main flame 15.

To reduce nitrogen oxide emissions main burner 3 is operated with a surplus of combustion air 11 so that a leaner mixture is produced. The pre-mixing ensures that the mixture is largely homogeneous and thereby a more even flame temperature is produced. This leaner pre-mix combustion is however hard to regulate and extinguishes easily. It is correspondingly susceptible to combustion instabilities that through acoustic coupling with the environment, such as a combustion chamber wall, can lead to production of a stable combustion variation. Such combustion variations lead to a high noise load or even to damage to the burner.

Pilot burner 5 is used to stabilize the main flame 15. It features a pilot air channel 21 through which the combustion air 11 is fed. In addition the pilot burner 5 features a pilot fuel channel 23 through which the fuel 13 is fed. The combustion air 11 and the fuel 13 are fed through a fine-pore combustion material 41. The pilot burner 5 is thus designed as a pore burner. Before it enters the combustion material 41 the combustion air 11 is mixed with the fuel 13. A combustion reaction is already taking place in the combustion material 41. The main flame 15 is stabilized by a pilot flame 25 at the outlet of the pilot burner 5. The combustion material 41 reduces the nitrogen oxide emissions by smoothing out and by reducing the flame temperature. Furthermore, especially by the heating up of the combustion material 41, a stable combustion which is not at all sensitive to air or gas variations is produced and thereby also a lower tendency for the formation of combustion variations.

Figure 2:
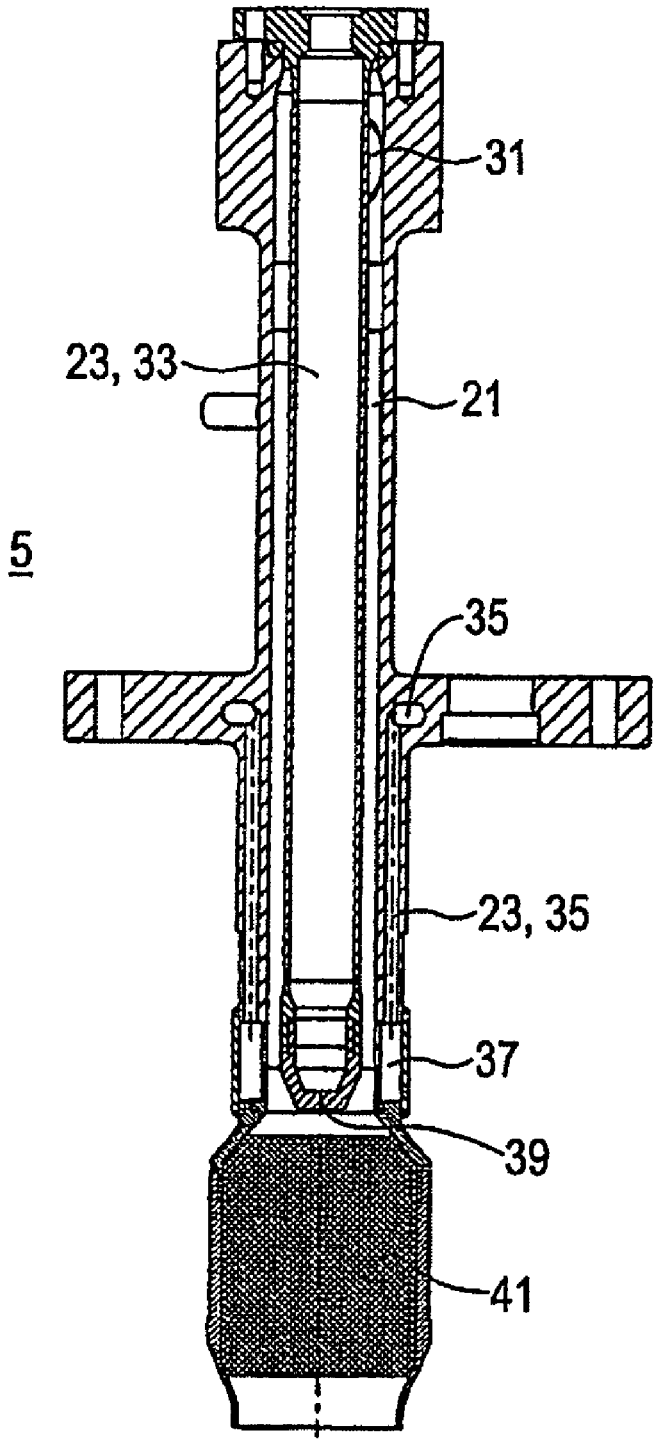
FIG. 2 a lengthwise cross section of a pilot burner of the pre-mix burner in accordance with FIG. 1, and FIG. 3 a schematic of a gas turbine with a pre-mix burner in accordance with FIGS. 1 and 2.

In the pilot burner 5 shown in FIG. 2 the pilot fuel channel 23 comprises a gas lance 23 und an additional channel 35, producing a more easily adaptable routing of fuel 13 to meet the requirements of the pilot fuel. The combustion material 41 is located after the mouth 39 of the gas lance 23, a mouth 39 of additional channel 37 and the pilot air channel 21. It is molded from a ceramic material and has a corresponding fine-pore structure. It will also be conceivable to make the combustion material 41 from a mixture of materials, in which case one or more of components of this mixture would subsequently be removed so that the fine-pore structure of the combustion material 41 remained.

Figure 3:
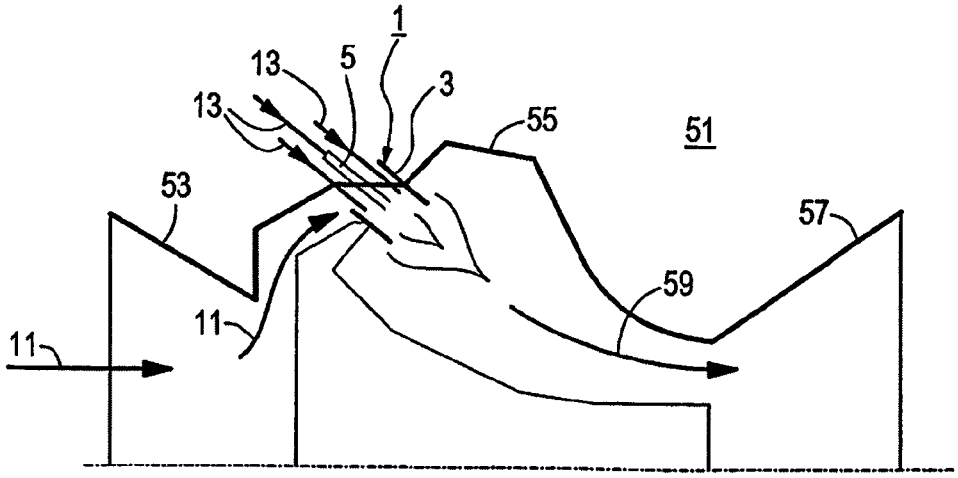

The gas turbine 51, shown in FIG. 3, features a compressor 53, a ring combustion chamber 55 and a turbine section 57. The Combustion air 11 is highly compressed in compressor 53 and fed to the ring combustion chamber 55. Using a pre-mix burner 1 of the type described above it is burned there with fuel 13 to form a hot gas 59 which drives the turbine section 17.

The invention claimed is:

1. A pre-mix burner for mixing combustion air with fuel to form a combustion gas mixture and subsequent combustion of the combustion gas mixture comprising:

a fuel-lean main burner adapted to receive the greater concentration of the combustion air; and a fuel-rich pilot burner adapted to stabilize a lean combustion in the main burner, wherein the pilot burner is a pore burner with a combustion material that has a fine-pore structure, wherein the pre-mix burner is configured such that the combustion gas mixture flowing from the pilot burner and the combustion gas mixture flowing from the main burner merge to a common outlet.

2. The pre-mix burner in accordance with claim 1, wherein the fine-pore structure is formed by the foaming of the combustion material.

3. The pre-mix burner in accordance with claim 1, wherein the combustion material is ceramic.

4. The pre-mix burner in accordance with claim 3, wherein the combustion material comprises Zirconium Oxide or Silicon Carbide.

5. The pre-mix burner in accordance with claim 1, wherein the combustion material is a Nickel or Cobalt based super alloy.

6. The pre-mix burner in accordance with claim 1, wherein the combustion material is a highly heat-resistant steel.

7. The pre-mix burner in accordance with claim 1, further comprising: a ring channel for the combustion air of the main burner that surrounds the pilot burner.

8. A gas turbine, comprising:

a pre-mix burner, the pre-mix burner comprising:

a fuel lean main burner adapted to receive the greater concentration of the combustion air; and a fuel rich pilot burner adapted to stabilize a lean combustion in the main burner, wherein the pilot burner is a pore burner with a combustion material that has a fine-pore structure and having a channel for assisting routing of a fuel, wherein the pre-mix burner is configured such that the combustion gas mixture flowing from the pilot burner and the combustion gas mixture flowing from the main burner merge to a common outlet.

9. The gas turbine in accordance with claim 8, further comprising a ring-shaped combustion chamber.

10. A method for operating a pre-mix burner, comprising:

mixing combustion air with fuel to receive a combustion gas mixture, whereby the mixing is performed by a fuel-lean main burner; and burning the combustion gas mixture the combustion being stabilized in the main burner by a fuel-rich pilot burner, wherein a combustion reaction takes place in the pilot burner with in a fine-pore combustion material, wherein the pre-mix burner is configured such that the combustion gas mixture flowing from the pilot burner and the combustion gas mixture flowing from the main burner merge to a common outlet.

11. The method in accordance with claim 10, wherein the pre-mix burner comprises: a main burner adapted to receive the greater part of the combustion air; and a pilot burner adapted to stabilize a lean combustion in the main burner, wherein the pilot burner is a pore burner with a combustion material that has a fine-pore structure.

12. The pre-mix burner in accordance with claim 2, wherein the combustion material is ceramic.

13. The pre-mix burner in accordance with claim 2, wherein the combustion material is a Nickel or Cobalt based super alloy.

14. The pre-mix burner in accordance with claim 2, wherein the combustion material is a highly heat-resistant steel.

15. The pre-mix burner in accordance with claim 2, further comprising a ring channel for the combustion air of the main burner that surrounds the pilot burner.

16. The gas turbine in accordance with claim 8, wherein the gas turbine is a stationary gas turbine.

17. The pre-mix burner in accordance with claim 1, further comprising a gas lance located before the combustion material that provides a secondary throughway for fuel to flow to the pilot burner.

18. The gas turbine in accordance with claim 8, further comprising a secondary channel for assisting routing of a fuel.

19. The method in accordance with claim 10, having a pilot fuel channel located upstream of the combustion material.

* * * * *